US010376903B2

(12) United States Patent
Chen et al.

(10) Patent No.: US 10,376,903 B2
(45) Date of Patent: Aug. 13, 2019

(54) OVERHEAD SHOWER HEAD THAT CAN BE ASSEMBLED OR DISASSEMBLED WITHOUT A WRENCH

(71) Applicants: XIAMEN SOLEX HIGH-TECH INDUSTRIES CO., LTD., Xiamen (CN); Huasong Zhou, Xiamen (CN)

(72) Inventors: Donghai Chen, Xiamen (CN); Yuehua Qiu, Xiamen (CN); Qihua Fan, Xiamen (CN); Wenxing Chen, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 198 days.

(21) Appl. No.: 15/153,316

(22) Filed: May 12, 2016

(65) Prior Publication Data

US 2017/0106380 A1 Apr. 20, 2017

(30) Foreign Application Priority Data

Oct. 19, 2015 (CN) ..... 201510679257

(51) Int. Cl.
*B05B 15/654* (2018.01)
*B05B 1/18* (2006.01)
*E03C 1/04* (2006.01)

(52) U.S. Cl.
CPC ..... *B05B 1/185* (2013.01); *B05B 15/654* (2018.02); *E03C 1/0409* (2013.01); *B05B 1/18* (2013.01)

(58) Field of Classification Search
CPC ..... B05B 1/185; B05B 15/065; E03C 1/0409
USPC ..... 239/600
See application file for complete search history.

(56) References Cited

U.S. PATENT DOCUMENTS 2,761,738 A * 9/1956 Swan ..... B05B 3/0427 239/383
2,862,766 A * 12/1958 Ward ..... A45D 19/02 239/557
3,130,919 A * 4/1964 Baker ..... B05B 1/185 239/458
3,473,736 A * 10/1969 Heitzman ..... B05B 3/04 137/625.31
4,968,202 A * 11/1990 Lanham ..... B60B 7/00 411/377

(Continued)

FOREIGN PATENT DOCUMENTS

DE 202005000881 * 1/2005 ..... B05B 1/18

*Primary Examiner* — Chee-Chong Lee
(74) *Attorney, Agent, or Firm* — Rabin & Berdo, P.C.

(57) ABSTRACT

The present invention provides an overhead shower head, which needn't a wrench when assembled and disassembled, the overhead shower head comprises a shower head main body and a universal ball disposed in a ball fixing seat at the rear side of the shower head main body; wherein an abutting fitting portion is disposed between the universal ball and the ball fixing seat, when the universal ball and the ball fixing seat rotate relatively, the abutting fitting portion abuts in the rotating direction, so that the universal ball and the ball fixing seat rotate together. The assembly and disassembly of the overhead shower head of the present invention can be achieved by just rotating the shower head main body without using tools such as a wrench, the assembly is fast and convenient.

12 Claims, 9 Drawing Sheets

(56) References Cited

U.S. PATENT DOCUMENTS 5,411,157 A * 5/1995 King ..... B65D 1/02
215/216

* cited by examiner

OVERHEAD SHOWER HEAD THAT CAN BE ASSEMBLED OR DISASSEMBLED WITHOUT A WRENCH

FIELD OF THE INVENTION

The present invention relates to a shower head, especially to a overhead shower head.

BACKGROUND OF THE INVENTION

Traditional overhead shower head is disposed with a universal ball that can rotate 360° with respect to the shower head main body; when assembling the overhead shower head, the shower head main body is driven to rotate to drive the universal ball to rotate, so that the universal ball is threaded and locked to the support arm. However, as the friction of the universal ball and the shower head main body is invariant, the tightening force of the universal ball and the support arm is gradually increased during the threading. When the tightening force of the universal ball and the support arm is larger than the friction of the universal ball and the shower head main body, if keeping rotating the shower head main body, the universal ball would not rotate together, so that the universal ball can not be tightly locked to the support arm, it usually needs a wrench or other tools to lock the universal ball and the support arm tightly, the assembly is inconvenient, so is the disassembly, it also needs a wrench or other tools to release the universal ball and the support arm to rotate the shower head main body to drive the universal ball to rotate together.

SUMMARY OF THE INVENTION

The present invention is provided with an overhead shower head to solve the technical problem of the existing technology, it needn't a wrench to fix the overhead shower head or detach the overhead shower head when assembling or disassembly, it is convenient and fast.

The technical proposal of the present invention is that: an overhead shower head, which needn't a wrench when assembled and disassembled, the overhead shower head comprises a shower head main body and a universal ball disposed in a ball fixing seat at the rear side of the shower head main body; wherein an abutting fitting portion is disposed between the universal ball and the ball fixing seat, when the universal ball and the ball fixing seat rotate relatively, the abutting fitting portion abuts in the rotating direction, so that the universal ball and the ball fixing seat rotate together.

In another preferred embodiment, the abutting fitting portion comprises a stop block disposed at the side surface of the universal ball and a limit slot disposed in the ball fixing seat; when the ball fixing seat and the universal ball rotate relatively, the stop block rotates in the limit slot, when the stop block moves to the end of the limit slot and abuts against the end of the limit slot, the ball fixing seat and the universal ball rotates together.

In another preferred embodiment, the limit slot is disposed in an internal periphery surface of a ratchet wheel, the external periphery of the ratchet wheel and the internal periphery of the ball fixing seat are disposed with cooperating ratchets.

In another preferred embodiment, when the overhead shower head finishes the assembling, the overhead shower head keeps on rotating, the ratchets of the ball fixing seat and the external periphery of the ratchet wheel squeeze, so that the ratchets of the external periphery of the ratchet wheel deform inwardly and then leave away from the ratchets of the external periphery of the ball fixing seat.

In another preferred embodiment, the ball fixing seat have three limit slots that are arranged with space in the internal periphery surface of the ratchet wheel; the external periphery of the limit slot is disposed with ratchets at the spaces, an elastic groove is disposed between the ratchet and the internal periphery of the limit slot.

In another preferred embodiment, the central angle of the limit slot is 110°.

In another preferred embodiment, one end of the universal ball extends out of the ball fixing seat, the extending end is disposed with internal thread to connect to a support arm and a screen spacer.

In another preferred embodiment, a nut is further provided, the external periphery of the side surface of the ball fixing seat is disposed with thread coupling to the nut.

In another preferred embodiment, the top portion of the nut is disposed with an opening, the extending end of the universal ball extends out of the ball fixing seat through the opening.

In another preferred embodiment, the ball fixing seat is disposed with a sealing ring coupling to the universal ball.

Compared to the existing known technology, the technical proposal of the present invention has advantages as follow:

1. the overhead shower head that can be assembled and disassembled without a wrench of the present invention is provided that an abutting fitting portion is disposed between the universal ball and the ball fixing seat, when the universal ball and the ball fixing seat rotate relatively, the abutting fitting portion abuts to make the universal ball and the ball fixing seat rotate together, so that the assembly and disassembly can be achieved by just rotating the shower head main body without using tools such as a wrench, the assembly is fast and convenient.
2. ratchets are disposed at the external periphery of the limit slot and the internal periphery of the ball fixing seat, when the shower head main body rotates, the ball fixing seat drives the limit slot to rotate, when the stop block at the side of the ball fixing seat abuts against the end of the limit slot, the universal ball rotates with the ball fixing seat, so that the internal thread at the end of the ball is coupled to the external thread of the end of the support arm, the shower head main body is then assembled to the end of the support arm.
3. when the torsion force of the internal thread of the end of the ball and the external thread of the end of the support arm reaches to the preset value, the overhead shower head main body is assembled to the support arm, if the user keeps on rotating the shower head main body, the ratchets of the ball fixing seat and the external periphery of the ratchet wheel squeeze, so that the ratchets of the external periphery of the ratchet wheel deform inwardly and then leave away from the ratchets of the external periphery of the ball fixing seat. The ratchet wheel can rotate with respect to the ball fixing seat, the staggered ratchets makes takh-takh sound to alarm user that the assembly is finished.

DETAILED DESCRIPTION OF THE EMBODIMENTS

The First Embodiment

Figure 1:
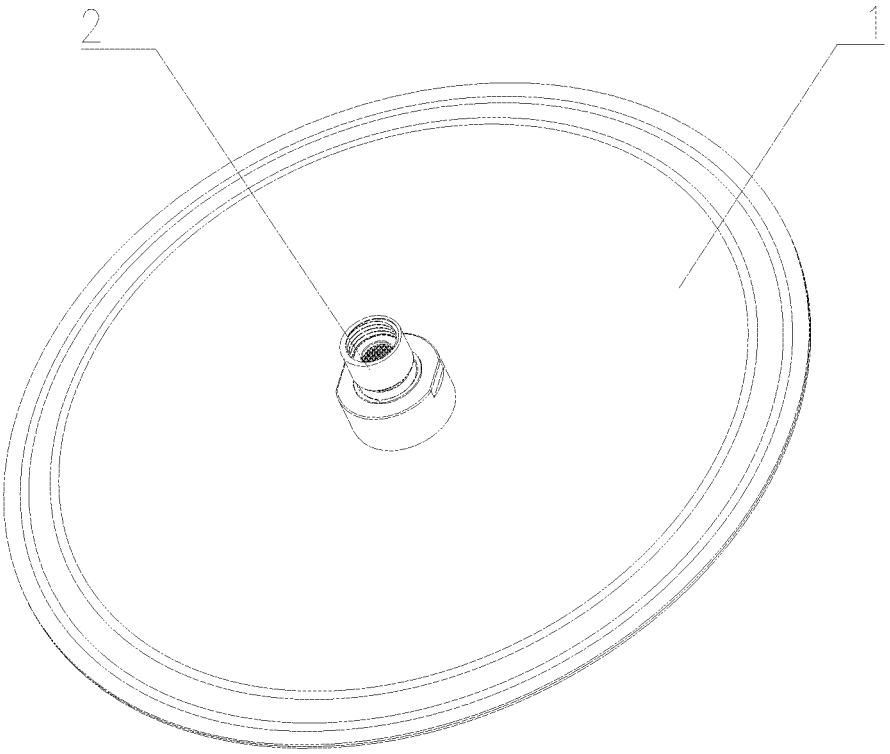
FIG. 1 illustrates a schematic diagram of a first embodiment of the present invention.
Figure 2:
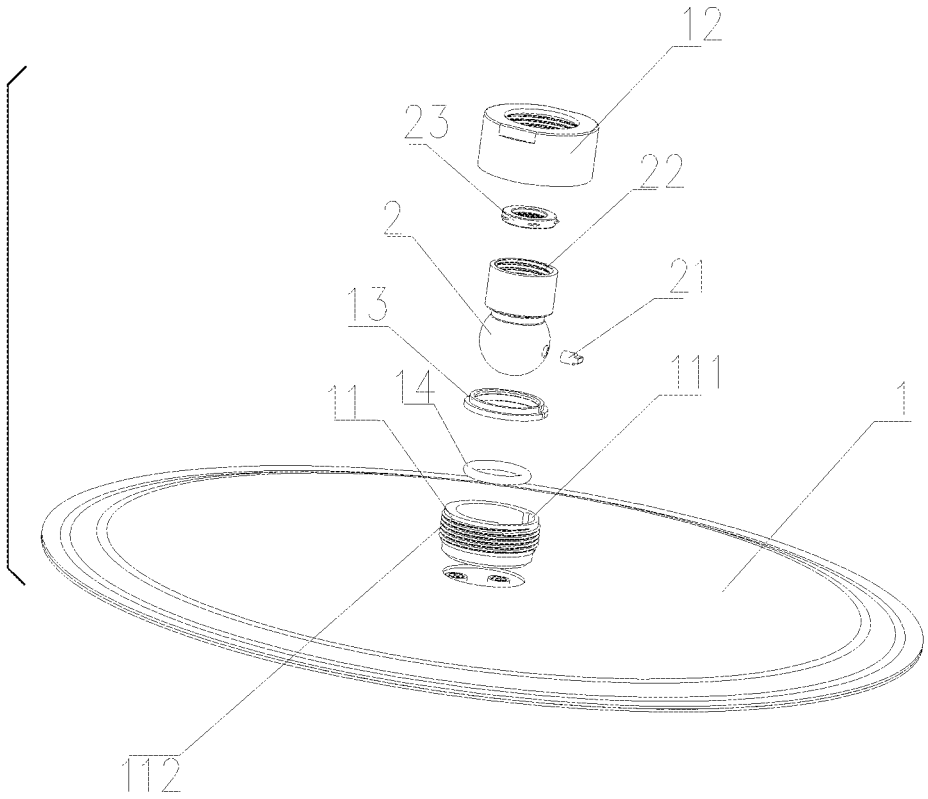
FIG. 2 illustrates an exploded and schematic diagram of the first embodiment of the present invention.
Figure 3:
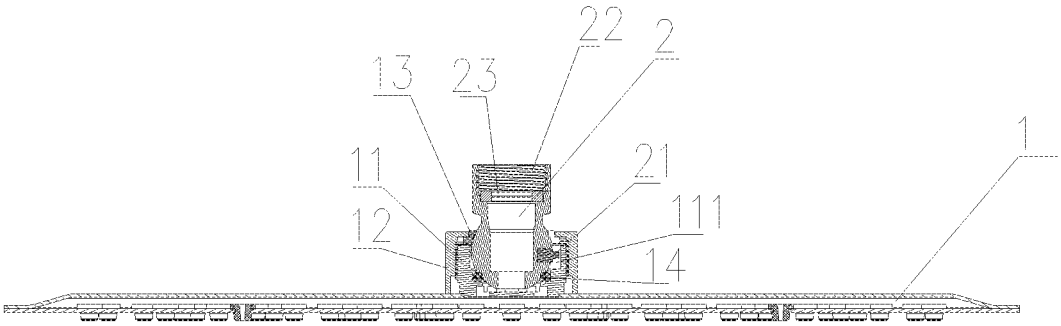
FIG. 3 illustrates a sectional diagram of the first embodiment of the present invention.
Figure 4:
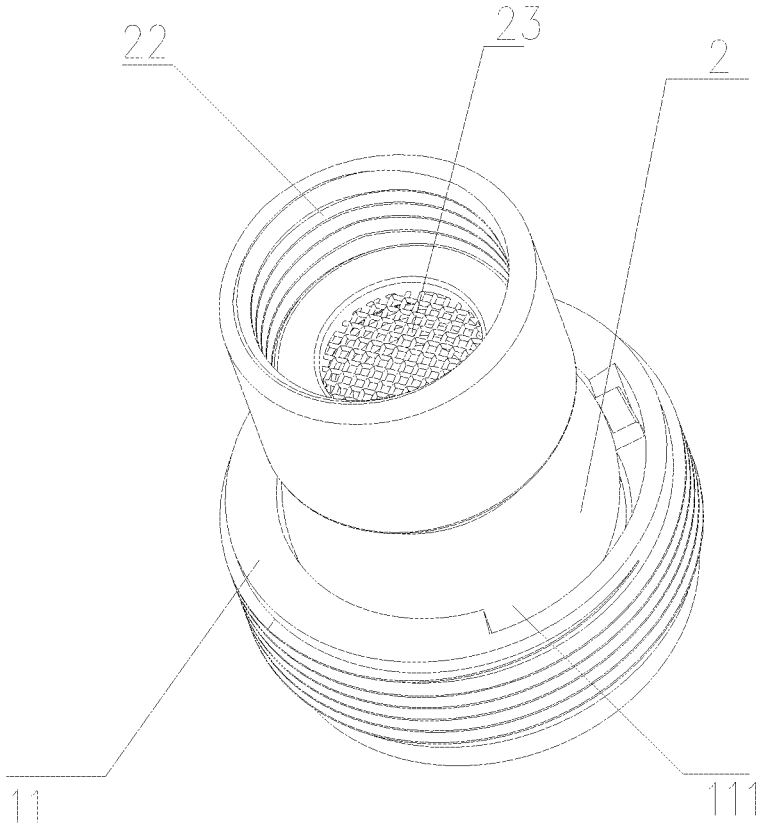
FIG. 4 illustrates a schematic diagram of the abutting fitting portion of the first embodiment of the present invention.

Referring to FIGS. 1~4, the overhead shower head that can be assembled and disassembled without a wrench comprises a shower head main body 1 and a universal ball 2 disposed in a ball fixing seat 11 at the rear side of the shower head main body 1; an abutting fitting portion is disposed between the universal ball 2 and the ball fixing seat 11, when the ball fitting set 11 and the universal ball 2 rotate relatively, the abutting fitting portion abuts in the rotating direction, so that the universal ball 2 and the ball fixing seat 11 rotate together.

In this embodiment, the abutting fitting portion comprises a stop block 21 disposed at the side surface of the universal ball 2 and a limit slot 111 disposed in the ball fixing seat 11; when the ball fixing seat 11 and the universal ball 2 rotate relatively, the stop block 21 rotates in the limit slot 111, when the stop block 21 moves to the end of the limit slot and abuts against the end of the limit slot 111, the ball fixing seat 11 and the universal ball 2 rotates together.

One end of the universal ball 2 extends out of the ball fixing seat 11, the extending end is disposed with internal thread 22 to connect to a support arm and a screen spacer 23.

Figure 5:
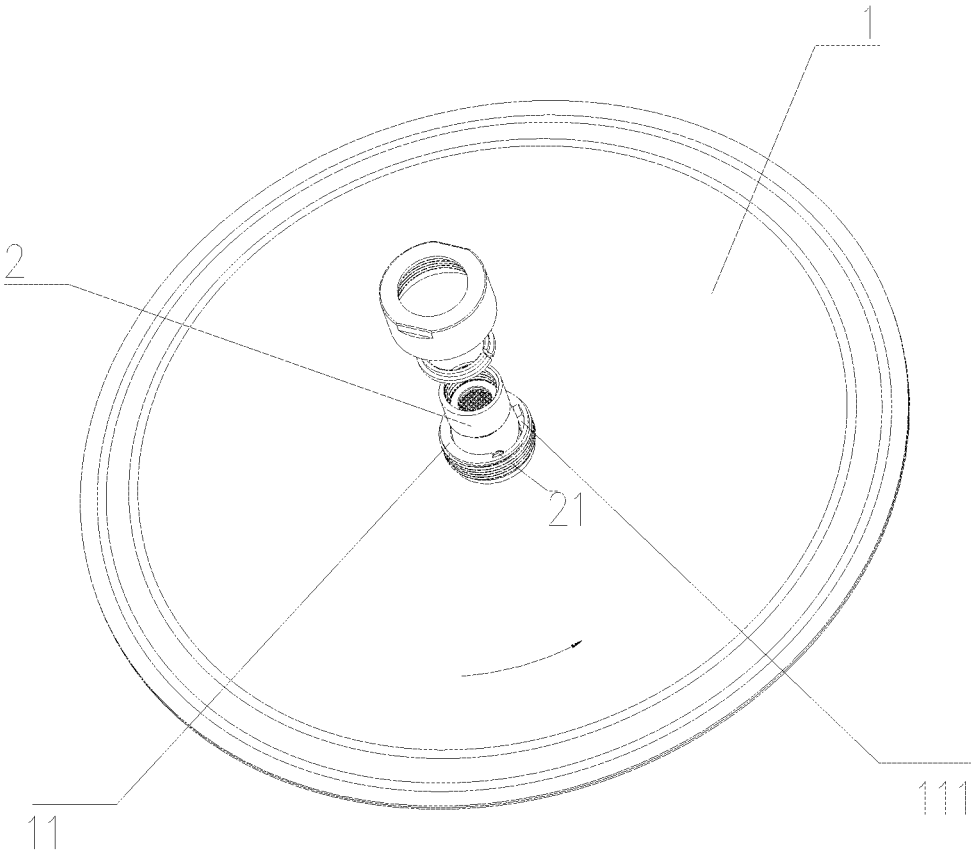
FIG. 5 illustrates a schematic diagram of the assembly of the first embodiment of the present invention.

Referring to FIG. 5, the overhead shower head of the present invention has the assembling process as follows: directing the thread 22 to the support arm, holding the edge of the shower head main body 1 with a hand to rotate the shower head main body 1 in the counter-clockwise direction, so that the main body 1 drives the universal ball 2 to rotate together, the thread 22 is threaded to the support arm. When the tightening force of the thread 22 and the support arm is larger than the friction force of the universal ball 2 and the ball fixing seat 11, the thread 22 can not rotate anymore. At this time, if keeping on rotating the shower head main body 1 in counter-clockwise direction, the shower head main body 1 and the universal ball 2 rotate relatively, the stop block 21 and the limit slot 111 also rotate relatively, when the stop block 21 moves to the end of the limit slot 111 and abuts against the end of the limit slot 111, keeping on rotating the shower head main body 1, under the action of the abutting force, the shower head main body 1 drives the universal ball 2 to rotate, so that the thread 22 is tightly threaded to the support arm.

Figure 6:
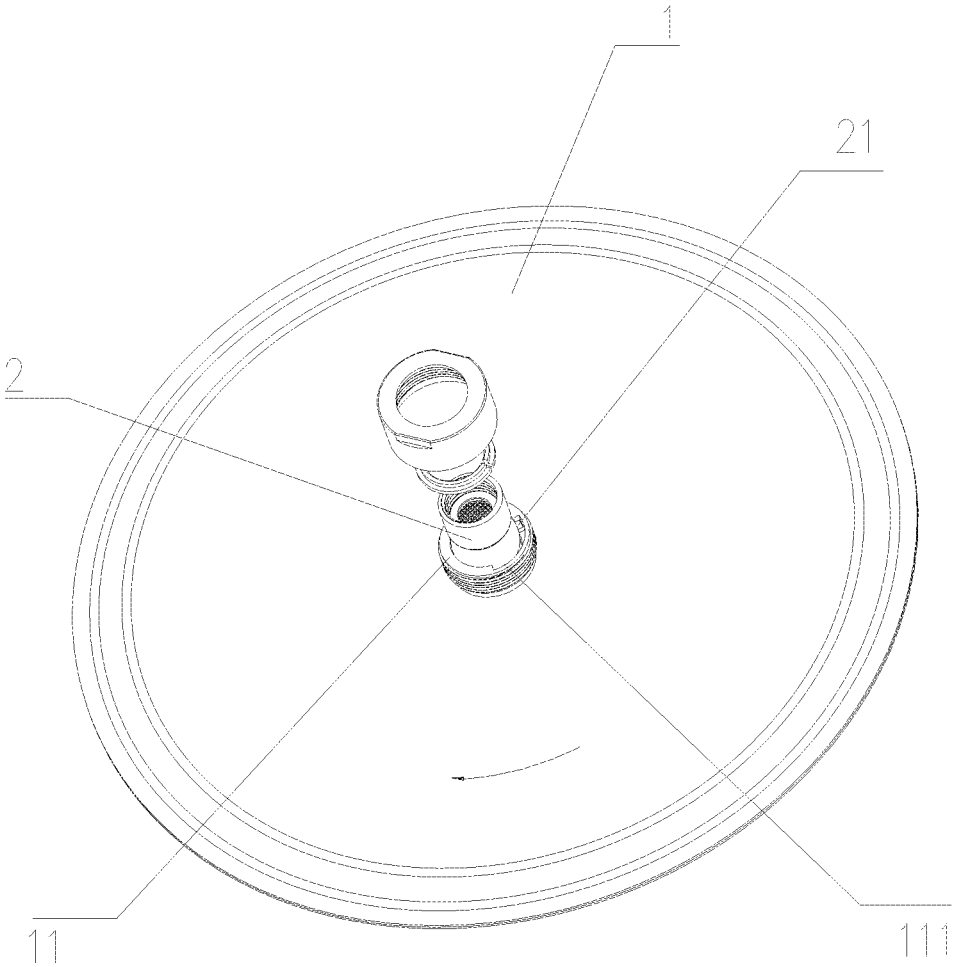
FIG. 6 illustrates a schematic diagram of the disassembly of the first embodiment of the present invention.

Referring to FIG. 6, the overhead shower head of the present invention has the disassembly process as follow: holding the edge of the shower head main body 1 to rotate the shower head main body 1 in clockwise direction, as the tightening force of the thread 22 and the support arm is larger than the friction force of the universal ball 2 and the ball fixing seat 11, the universal ball 2 and the shower head main body 1 rotate relatively, the stop block 21 and the limit slot 111 also rotate relatively, when the stop block 21 moves the end of the limit slot 111 and abuts against the end of the limit slot 111, keeping on rotating the shower head main body 1, under the work of the abutting force, the shower head main body 1 can drive the universal ball 2 to rotate together, so that the thread 22 is unlocked to the support arm to finish the disassembling.

As can be seen from above, the overhead shower head that can be assembled and disassembled without a wrench is provided that the assembly and disassembly can be achieved by just rotating the shower head main body without any tools such as a wrench, the assembly is quick and convenient.

The present invention can be preferred configured:

The limit slot 111 is an annular arc slot, the central angle is arranged of 1°~360°. In this embodiment, it is 110°. The relative rotation angle of the universal ball 2 and the ball fixing seat 11 is arranged of 1°~360°, it would not be limited to the rotation angle of the universal ball due to the configuration of the abutting fitting portion.

Therefore, it can keep the whole functions of the existing overhead shower heads.

The overhead shower head further comprises a nut 12, the external periphery of the side surface of the ball fixing seat 11 is disposed with thread 112 coupled to the nut. The top portion of the nut 12 is disposed with an opening 121, the extending end of the universal ball 2 extends out of the ball fixing seat 11 through the opening 121. A bush 13 is disposed between the opening 121 and the universal ball. The universal ball set 11 is disposed with a sealing ring 14 coupled to the universal ball 2.

The Second Embodiment

Figure 7:
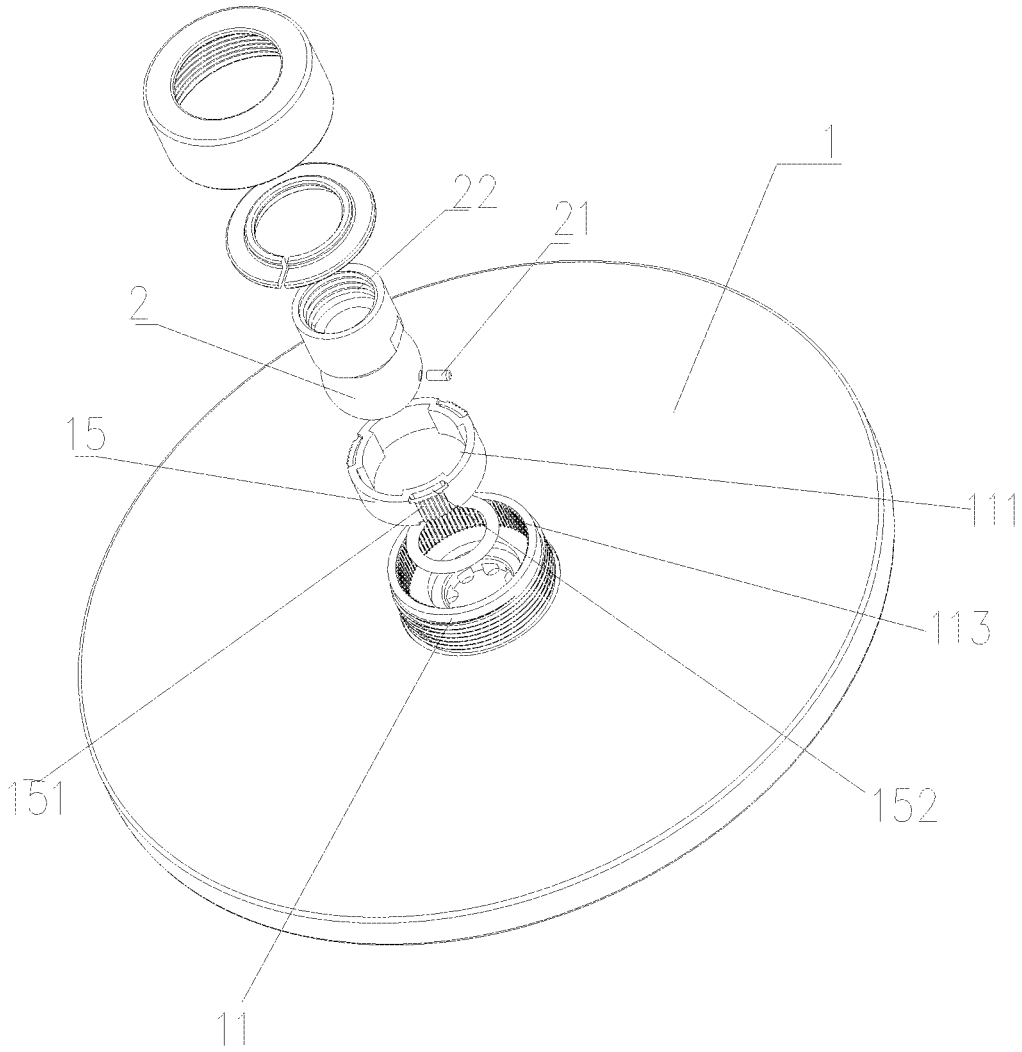
FIG. 7 illustrates an exploded and schematic diagram of a second embodiment of the present invention.
Figure 8:
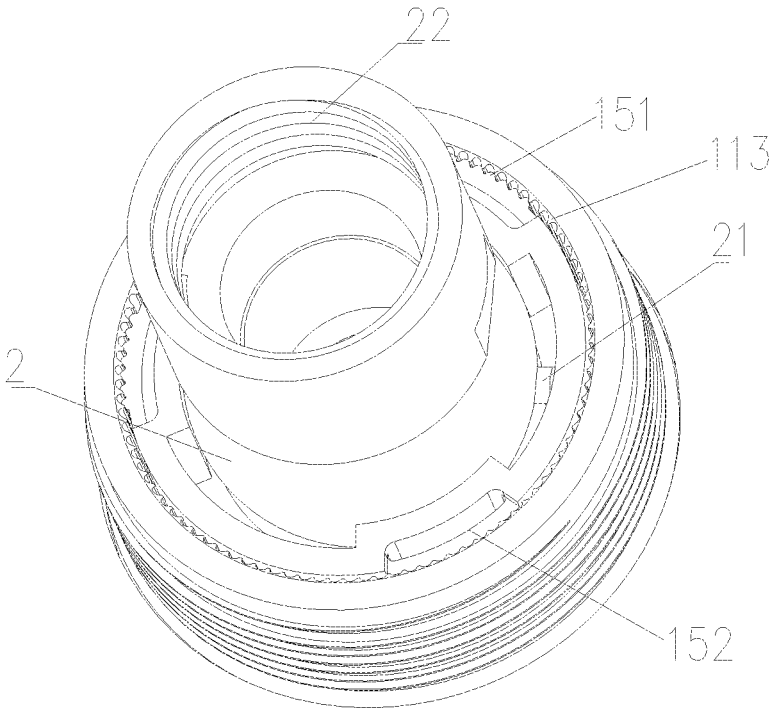
FIG. 8 illustrates a schematic diagram of the abutting fitting portion of the second embodiment of the present invention.
Figure 9:
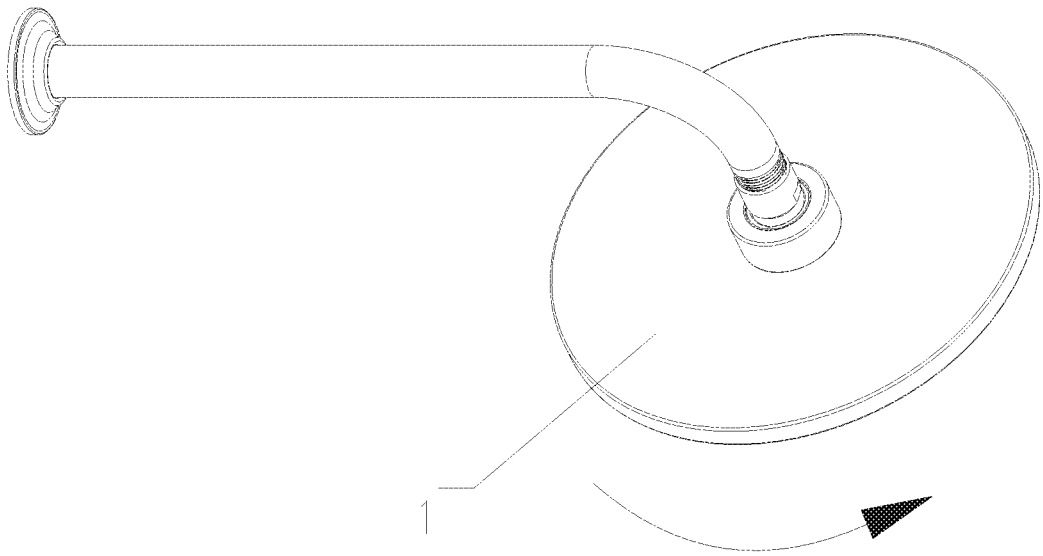
FIG. 9 illustrates a schematic diagram of the disassembly of the second embodiment of the present invention.

Referring to the FIGS. 7~9, this embodiment differs from the first embodiment in that:

This embodiment comprises three limit slots 111, they are arranged with space at the internal periphery surface of the ratchet wheel 15, the external periphery of the ratchet wheel 15 is disposed with ratchets 113, 151 at the spaces coupled to the internal periphery of the ball fixing seat 11. And an elastic groove 152 is disposed between the ratchet 151 at the external periphery of the ratchet wheel 15 and the internal periphery of the ratchet wheel 15.

The assembling process of the overhead shower head of this embodiment is that: directing the thread 22 to the support arm, holding the edge of the shower head main body 1 with a hand to rotate the shower head main body 1 in the counter-clockwise direction, so that the main body 1 drives the universal ball 2 to rotate together, the thread 22 is threaded to the support arm. When the tightening force of the thread 22 and the support arm is larger than the friction force of the universal ball 2 and the internal periphery of the ratchet wheel 15, the thread 22 can not rotate any more. At this time, if keeping on rotating the shower head main body 1 in counter-clockwise direction, the shower head main body 1 and the universal ball 2 rotate relatively, the stop block 21 and the limit slot 111 also rotate relatively, when the stop block 21 moves to the end of the limit slot 111 and abuts against the end of the limit slot 111, keeping on rotating the shower head main body 1, under the action of the abutting force, the shower head main body 1 drives the universal ball 2 to rotate, so that the thread 22 is tightly threaded to the support arm. When the thread 22 is tightly threaded to the support arm, keeping on rotating the shower head main body 1, as the friction of the thread 22 and the support arm is larger than the occlusive force of the ratchets 113, 151 of the external periphery of the ratchet wheel 15 and the internal periphery of the ball fixing seat 11, the ball fixing seat and ratchet 151 of the external periphery of the ratchet wheel 15 squeeze, so that the ratchets of the external periphery of the ratchet wheel 15 deform towards the elastic groove 152 and then leave away from the ratchet 113 of the external periphery of the ball fixing seat 11. The ratchet wheel 15 can rotate with respect to the ball fixing seat 11, the staggered ratchets 113, 151 make takh-takh sound to alarm user that the assembly is finished. Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An overhead shower head, comprising:

a shower head main body; and a universal ball disposed in a ball fixing seat at a rear side of the shower head main body, the universal ball including a passage extending through the universal ball and being in communication with an opening of the shower head main body, wherein an abutting fitting portion is disposed between the universal ball and the ball fixing seat, the abutting fitting portion configured such that when the ball fixing seat rotates, in a rotation direction, through a first rotation angle, the abutting fitting portion allows the ball fixing seat to rotate relative to the universal ball through a second rotation angle less than the first rotation angle, and, when the ball fixing seat has rotated through the second rotation angle, the abutting fitting portion engages the universal ball with the ball fixing seat in the rotating direction, so that the universal ball and the ball fixing seat rotate together through a third rotation angle corresponding to a difference between the first rotation angle and the second rotation angle, wherein the abutting fitting portion comprises a stop block disposed at a side surface of the universal ball and a limit slot disposed in the ball fixing seat, wherein the stop block and the limit slot are configured such that when the ball fixing seat and the universal ball rotate relative to each other, the stop block rotates in the limit slot, and when the stop block moves to an end of the limit slot and abuts against the end of the limit slot, the ball fixing seat and the universal ball rotate together, wherein the limit slot is disposed in an internal periphery surface of a ratchet wheel, an external periphery of the ratchet wheel and an internal periphery of the ball fixing seat are disposed with interlocking ratchets, and wherein the ratchets of the ball fixing seat and the external periphery of the ratchet wheel are configured such that rotating the universal ball relative to the ball fixing seat at a predetermined angle, after engaging the ratchets of the ball fixing seat and the external periphery of the ratchet wheel, causes the ratchets of the ball fixing seat and the external periphery of the ratchet wheel to squeeze, so that the ratchets of the external periphery of the ratchet wheel deform inwardly and separate from the ratchets of an external periphery of the ball fixing seat.

2. The overhead shower head according to claim 1, wherein the limit slot of the ratchet wheel includes three limit slots that are separated from each other on an internal peripheral surface of the ratchet wheel, the ratchets of the ratchet wheel are located on an external peripheral surface of the three limit slots, and an elastic groove is disposed between each ratchet of the ratchet wheel and an internal periphery of a respective limit slot among the three limit slots.

3. The overhead shower head according to claim 2, wherein a central angle of the limit slot is 110°.

4. The overhead shower head according to claim 3, wherein the ball fixing seat is disposed with a sealing ring coupling to the universal ball.

5. The overhead shower head according to claim 2, wherein the ball fixing seat is disposed with a sealing ring coupling to the universal ball.

6. The overhead shower head according to claim 1, wherein one end of the universal ball extends out of the ball fixing seat, and is disposed with internal thread to connect to a support arm and a screen spacer.

7. The overhead shower head according to claim 6, further comprising a nut, wherein the external periphery of the ball fixing seat, on a side surface, is disposed with thread coupling to the nut.

8. The overhead shower head according to claim 7, wherein a top portion of the nut includes an opening, and the one end of the universal ball extends out of the ball fixing seat through the opening.

9. The overhead shower head according to claim 8, wherein the ball fixing seat is disposed with a sealing ring coupling to the universal ball.

10. The overhead shower head according to claim 7, wherein the ball fixing seat is disposed with a sealing ring coupling to the universal ball.

11. The overhead shower head according to claim 6, wherein the ball fixing seat is disposed with a sealing ring coupling to the universal ball.

12. The overhead shower head according to claim 1, wherein the ball fixing seat is disposed with a sealing ring coupling to the universal ball.

* * * * *